United States Patent [19]

Thakur

[11] 4,303,274

[45] Dec. 1, 1981

[54] DEGASIFICATION OF COAL SEAMS

[75] Inventor: Pramod C. Thakur, Morgantown, W. Va.

[73] Assignee: Conoco Inc., Ponca City, Okla.

[21] Appl. No.: 156,300

[22] Filed: Jun. 4, 1980

[51] Int. Cl.[3] ..... E21C 37/00

[52] U.S. Cl. ..... 299/12; 299/19; 299/2; 166/50

[58] Field of Search ..... 166/50, 314; 299/12, 299/19, 2

[56] References Cited

U.S. PATENT DOCUMENTS

| | | | |
|---|---|---|---|
| 3,650,564 | 3/1977 | Williamson | 299/12 |
| 3,814,480 | 6/1974 | Dahl | 299/2 |
| 3,934,649 | 1/1976 | Pasini et al. | 166/254 |
| 4,183,407 | 1/1980 | Knopnik | 166/50 |
| 4,194,580 | 3/1980 | Messenger | 166/50 |

FOREIGN PATENT DOCUMENTS

| | | | |
|---|---|---|---|
| 432295 | 6/1975 | U.S.S.R. | 299/12 |
| 608961 | 5/1978 | U.S.S.R. | 299/12 |
| 691568 | 10/1979 | U.S.S.R. | 299/12 |

*Primary Examiner*—William F. Pate, III

*Attorney, Agent, or Firm*—Richard W. Collins

[57] ABSTRACT

Mineable coal seams which are in proximity to an overlying or underlying coal seam are degasified in advance of and during mining by drilling a generally horizontal borehole in the overlying or underlying coal seam and producing gas therefrom.

1 Claim, 1 Drawing Figure

DEGASIFICATION OF COAL SEAMS

BACKGROUND OF THE INVENTION

This invention relates to degasification of coal seams, and more particularly to a method for degasifying a coal seam which is in proximity to an underlying or overlying coal seam.

Underground coal mining has always been subject to explosions caused by methane gas which is always present to some extent in the working area. In cases where the coal seam being mined is adjacent an overlying or underlying coal seam, methane gas from the overlying or underlying coal seam can infiltrate into the working area and aggravate the methane problem.

Several techniques have been used in the past to control the methane concentration in coal mines. The most common method is air ventilation to dilute the methane in the mine. More recently, the removal of methane through the use of boreholes drilled into or through a mineable coal seam has received considerable attention. A discussion of the prior art methods or removing methane utilizing boreholes drilled into or through coal seams is found in U.S. Pat. No. 3,934,649. As discussed therein, vertical boreholes from the surface have been drilled into coal seams, but their efficiency has been relatively low due to their failure to intersect the major natural fractures in the coal so that significant quantities of methane can be released. Also discussed therein is the technique of drilling horizontal boreholes through the coal seam. These horizontal boreholes have been quite effective in some cases, and their use is increasing.

SUMMARY OF THE INVENTION

According to the present invention, a mineable coal seam which is adjacent an overlying or underlying coal seam is degasified by drilling horizontal boreholes through the underlying or overlying coal seam and producing gas from the boreholes such that the amount of gas which infiltrates from the underlying or overlying coal seam into the mine working area is reduced. According to one aspect of the invention, horizontal boreholes are also drilled through the seam to be mined in addition to those drilled in the overlying or underlying seam. The horizontal boreholes used in the process of this invention are preferably drilled from an underground location adjacent the coal seam or seams to be drilled through, but directional drilling from the surface can also be utilized.

A particular problem exists when a coal seam which is being mined is overlain by an adjacent coal seam. As the seam is mined, the mine roof is allowed to collapse behind the working area, resulting in a highly permeable path between the overlying coal seam and the mined out area. This causes a substantial increase in the gas concentration in the mine working area, with resulting obvious hazards. When the process of this invention is employed, the gas level in the mine working area can be reduced.

BRIEF DESCRIPTION OF THE DRAWING

The drawing is a schematic illustration of the invention where a mineable coal seam is overlain by a second coal seam.

DESCRIPTION OF THE PREFERRED EMBODIMENTS

Figure 1:
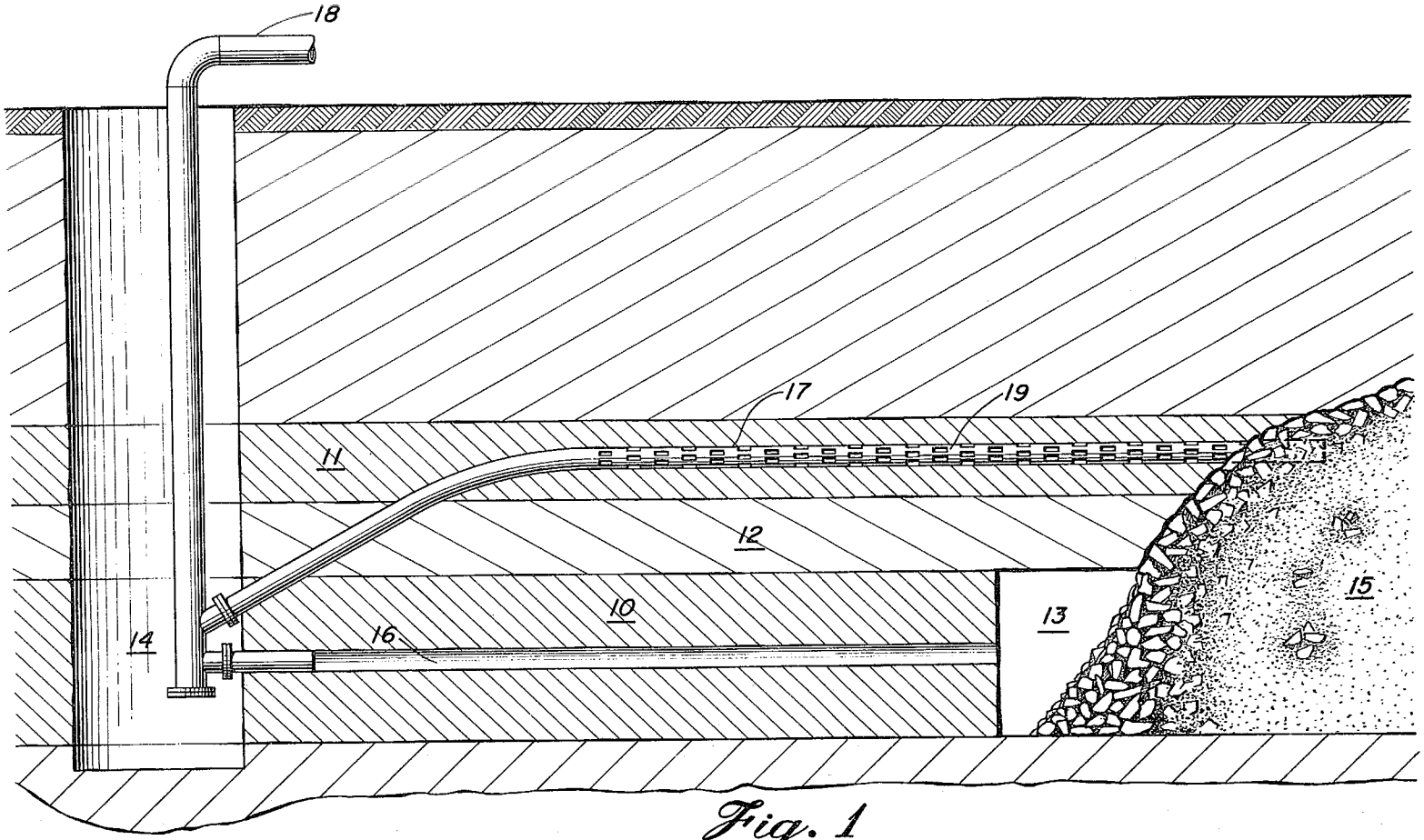

The most preferred embodiment of the invention will now be described with reference to the drawing.

A mineable coal seam 10 is overlain by a second coal seam 11. The two coal seams are separated by a layer of shale or sandstone 12. A mine working area 13 is shown, and the mining operation extends in a direction from mine working area 13 toward underground working area 14. Behind mine working area 13 is a gob or rubble zone 15 into which intermediate shale layer 12 and second coal seam 11 have collapsed to fill the void left by removal of a portion of the mineable coal seam 10. It will be apparent that, in the absence of the process of this invention, methane gas contained in overlying coal seam 11 would have ready access through the rubble zone to the mine working area 13.

According to the most preferred version of the invention, a horizontal borehole 16 is drilled from a first location, such as drilling area 14, through coal seam 10 to working area 13 prior to mining in the working area 13. A second borehole 17 is drilled through overlying coal seam 11 to the portion thereof over working area 13. Methane gas is produced from these boreholes before mining in the area 13. The gas may be produced either naturally or by inducing flow through gas production pipe 18. In some instances, it will be desirable to line borehole 17 with a perforated production pipe string 19 to prevent clogging of the borehole during subsequent collapse of coal seam 11 and shale layer 12. It is generally not necessary to put a production pipe in borehole 16.

After the rate of methane gas produced through production pipe 18 has dropped to an acceptable level, mining of coal seam 10 may be initiated or continued. It is desirable to continue production of gas through boreholes 16 and 17 as the mining operation progresses.

It will be apparent that, as the gas production continues, the amount of gas from both mineable coal seam 10 and overlying coal seam 11 which infiltrates into mine working area 13 will be greatly reduced due to the initial and continuing gas removal through boreholes 16 and 17, thereby providing a safer mining operation and reducing the amount of dilution air required to be forced through the mine working area.

The process of this invention applies also to a situation where a mineable coal seam is adjacent an underlying coal seam, or even underlying and overlying coal seams.

Technology is readily available for drilling generally horizontal boreholes through coal seams, either from a mine working area adjacent the coal seam or from the surface. The equipment and technique for drilling these boreholes does not constitute a part of the present invention.

The foregoing description of the preferred embodiment of the invention is intended for purposes of illustration rather than by way of limitation. The process is applicable for various types of mining such as long wall or room and pillar, and obviously could include a plurality of boreholes through one or more of the coal seams such that a substantial area could be treated.

I claim:

1. A method of degasifying a mineable coal seam which is overlain by a second coal seam comprising:

(a) forming a generally horizontal borehole in said second coal seam from a first location in an underground working area to a second location over an unmined portion of said mineable coal seam;

(b) installing a perforated production pipe in said borehole;

(c) producing gas from said borehole;

(d) then mining said unmined portion of said mineable coal seam, and (e) continuing to produce gas from said borehole as mining of said unmined portion of said mineable coal seam progresses.

* * * * *